United States Patent [19]

Harmon et al.

[11] Patent Number: 4,696,402

[45] Date of Patent: Sep. 29, 1987

[54] EASY-OPEN, INDIVIDUAL UNIT DISPENSING PACKAGE

[75] Inventors: Charles H. Harmon, Deforest; Thomas F. Ward, Madison; Robert W. Zimmermann, Sun Prairie, all of Wis.

[73] Assignee: Rayovac Corporation, Madison, Wis.

[21] Appl. No.: 713,554

[22] Filed: Mar. 19, 1985

[51] Int. Cl.[4] ..... B65D 5/54

[52] U.S. Cl. ..... 206/602; 206/333; 206/611

[58] Field of Search ..... 206/333, 194, 602, 611

[56] References Cited

U.S. PATENT DOCUMENTS

| | | | |
|---|---|---|---|
| 2,081,656 | 5/1937 | Anthony | 206/333 |
| 2,205,437 | 6/1940 | Ringler . | |
| 2,385,400 | 9/1945 | Briggs . | |
| 2,827,165 | 3/1958 | Gentry | 206/194 |
| 3,142,378 | 7/1964 | Lengsfield, Jr. | 206/602 |
| 3,169,691 | 2/1965 | Wood . | |
| 3,198,378 | 8/1965 | Farquhar | 206/194 |
| 3,276,574 | 10/1966 | Meyers . | |
| 3,424,306 | 1/1969 | Munck | 206/333 |
| 3,454,157 | 7/1969 | Kulig . | |
| 3,540,582 | 11/1970 | Wood et al. | 206/609 |
| 3,687,282 | 8/1972 | Owen | 206/194 |
| 3,721,338 | 3/1973 | Arneson | 206/194 |
| 3,881,601 | 5/1975 | Walus et al. | 206/333 |

FOREIGN PATENT DOCUMENTS

| | | | |
|---|---|---|---|
| 565821 | 11/1958 | Canada | 206/333 |

*Primary Examiner*—Stephen P. Garbe

[57] ABSTRACT

A novel package having a perforated tear strip with openings capable of firmly binding at least one side of individual product units and a means for enclosing and securing the other side of the individual product units in order to prevent the product units from engaging in motion sufficient to dislodge themselves. As the tear strip is torn back, product units are released individually and the undispensed product units remain securely in place. Such novel packaging is easily opened, is space efficient and can be made visually appealing.

10 Claims, 1 Drawing Figure

EASY-OPEN, INDIVIDUAL UNIT DISPENSING PACKAGE

This invention relates to novel packaging capable of dispensing one product unit at a time while securely holding undispensed product units in place. The packaging has good visual appeal, is space efficient and is easily opened.

BACKGROUND OF THE INVENTION

It is known in the packaging art that consumer appeal for a product can be enhanced by use of packaging having apertures or openings through which consumers can view the product. When multiple units are placed in such packaging, the packaged units are known as "multi-packs". Multi-packs are popular in marketing a wide variety of products such as beer, soft drinks, and a variety of aerosols. Multi-packs are preferably packed tightly so that collisions between units are minimized and units cannot reorient themselves and fall through the package apertures or openings.

A problem with such packages is that once they are opened by consumers, and especially once a product unit is removed, the remaining product units are no longer tightly packed. The remaining product units often collide with other units, reorient themselves and fall through apertures in the package. Putting separators between units renders it difficult to dispense those units and for practical purposes converts the multi-pack into a mere collection of single packages, each of which must be independently opened. Thus, the convenience normally associated with multi-packs is lost.

The opening of tightly packaged multi-packs can be greatly facilitated by providing the package with one or more perforated tear strips. However, once they are opened by removal of the tear strip, the multipacks cannot be effectively reclosed. Products remaining within the packages are left free to collide and to fall out of the package. This problem is particularly evident with multi-packs of batteries. A consumer often buys batteries for a particular purpose, and batteries not immediately placed in use by the consumer often are not needed for long periods of time. It is highly desirable, therefore, that such unused batteries remain securely packaged.

It is an object of the present invention to provide secure packaging for a plurality of product units wherein one unit at a time may be removed without dislodging or loosening remaining units.

It is a further object to provide a package which is easily opened, and from which units are easily dispensed.

It is a further object to provide packaging having apertures through which consumers can view at least some of the product units contained therein.

These and other objects are achieved by the practice of the present invention.

SUMMARY

The objects of the present invention are accomplished by novel packages having one or more perforated tear strips, at least one of which has one or more openings therein, each opening being capable of enclosing and securely binding at least one side of an individual product unit and which further comprise a means for preventing any product unit bound within an opening of a tear strip from engaging in motion sufficient to dislodge itself from the tear strip. Tear strips may be created by methods known in the packaging art. The package may optionally be open on one or more sides in order to visually display one or more product units therein.

Packaging prepared in accordance with the instant invention is particularly well suited for enclosing batteries. Openings in the tear strips can be made such that they fit around and securely bind battery electrodes. In a preferred embodiment of the invention, cutouts from the packaging are so placed as to be capable of enclosing and locking around portions of the base of a battery whose cathode is bound within an opening of a perforated tear strip. Batteries whose bases partially protrude from the package at the point of the cutouts will be so held in place that their cathodes cannot dislodge from the openings of the tear strip.

The invention is further elucidated by the following detailed description of certain preferred embodiments when read in conjunction with the drawing and description thereof.

DETAILED DESCRIPTION OF CERTAIN PREFERRED EMBODIMENTS

Figure 1:
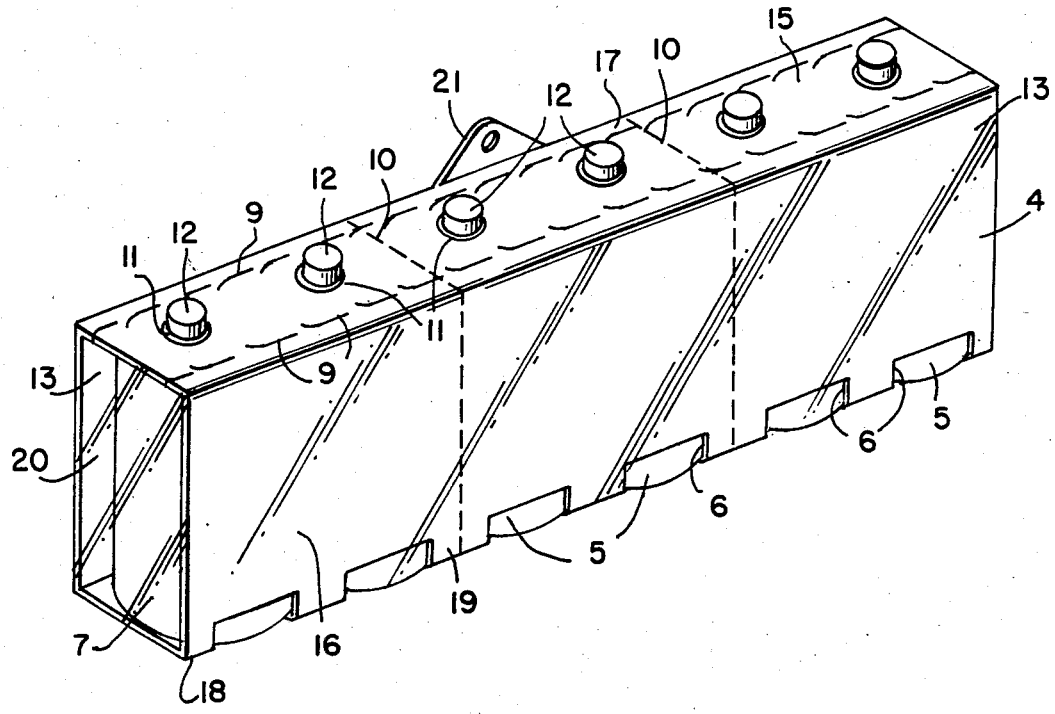

FIG. 1 is a perspective view of a closed package within the scope of the instant invention which is preferably a continuous piece of paper board or like material which has been previously die cut such that when it is wrapped tightly around batteries, it will have structural features similar to those shown.

There is shown in FIG. 1 a paper board carton 4 wrapped around six common cylindrically shaped batteries 7, two of which are highly visible through two open ends 13 of the carton. Differently shaped products can also be packaged in accordance with the invention. The carton forms side panels 16, top panel 17 and bottom panel 18, all of which extend between ends 13. Perforations 9 extend in two substantially parallel lines along top panel 17 from one open end 13 to the other, forming tear strip 15. Cathodes 12 of enclosed batteries 7 protrude from the carton through openings 11 in tear strip 15 and are held in place by said openings. Likewise, bases 5 of enclosed batteries 7 protrude from side panels 16 through cut-outs 6 and are held in place thereby. Carton 4 may optionally have perforations 10 around its entire circumference in a plane between consecutive batteries or groups of batteries such that the carton may be broken along said perforations into smaller cartons containing a lesser number of batteries.

The carton is easily opened by grasping tear strip 15 on one end and tearing it slowly across top panel 17 until a desired number of batteries 7 have been uncovered. The uncovered batteries are then freely removable from the carton while the remaining covered batteries remain firmly bound within openings in the unremoved portion of the tear strip. Though the container is no longer tightly packed, lateral movement and reorientation of remaining batteries is prevented by cutouts 6 which enclose portions of the base of each remaining battery. It is desirable to wrap the entire carton in a plastic wrap 20 and to provide a hanging means 21 so that the carton may be placed in hanging displays.

In certain preferred embodiments, the package of the invention is a smartly lithographed paper board or cardboard carton blank which has been die cut into a configuration which will wrap tightly around a number of product units in such a way as to form a carton similar to that of FIG. 1, and in such a way as to overlap beneath the bases of the wrapped units. It is desirable to join the overlapping portion together by hot melt glue or other process known in the art. A clear plastic shrink wrap is optionally added to give the package both eye appeal and tamper-proof security.

The packages of the instant invention enclose several product units in a space which can be quite small relative to the space necessary with more conventional packaging. This is an extremely advantageous quality of the instant packaging for consumers and distributors alike. Hanger tabs may optionally be added to enable the package to be displayed by hanging. Typical products suitable for packaging in accordance with the instant invention include but are not limited to, cylindrical batteries such as zinc-carbon cells and alkaline-manganese cells.

The terms and descriptions used herein are set forth by way of illustration only and are not meant as limitations. Those skilled in the art will recognize that most any product can be packaged in accordance with the instant invention, and that numerous variations are possible within the spirit and scope of the invention as defined in the following claims.

We claim:

1. An easily opened container capable of dispensing, one at a time, each of a plurality of individual product units placed therein, while securely holding each undispensed unit in place, which container comprises at least one perforated tear strip formed by two substantially parallel lines of perforations in close proximity to one another, the strip having at least two openings therein, each of which is capable of enclosing and securely binding a portion of an individual product unit, wherein the container further comprises means for preventing an individual product unit bound within one of said openings from engaging in motion sufficient to dislodge itself from an opening, wherein said means does not prevent easy removal of an individual product unit which is not bound by an opening.

2. The easily opened container of claim 1 further comprising at least one opening through which a product unit placed within the container could be viewed.

3. The easily opened container of claim 1 wherein the container has at least one group of perforations around its circumference which lie substantially in a single plane and which so weaken the container along the plane that the container can be broken into separate parts by tearing along the perforations.

4. The easily opened container of claim 1 wherein said means for preventing a product unit from engaging in motion sufficient to dislodge that portion of itself bound within said opening comprises at least one cutout so placed as to at least partially enclose a portion of a product unit other than the portion bound within said opening.

5. The easily opened container of claim 1 wherein the container further comprises a clear plastic wrap and hanging means.

6. An easily opened container capable of dispensing, one at a time, each of a plurality of batteries placed therein, while securely holding each undispensed battery in place, which container comprises at least one perforated tear strip formed by two substantially parallel lines of perforations in close proximity to one another, the tear strip having at least two openings therein, each of which is capable of enclosing and securely binding a battery electrode, wherein the container further comprises a means for preventing any battery whose electrode is bound within an opening of a tear strip from engaging in motion sufficient to dislodge its electrode from its opening, wherein said means does not prevent easy removal of batteries not bound by an opening.

7. The easily-opened container of claim 6 having at least one additional opening through which a battery placed within the container could be viewed.

8. The easily-opened container of claim 6 wherein the container has at least one group of perforations around its circumference which lie substantially in a single plane and which so weaken the container along the plane that the container can be broken into separate parts by tearing along the perforations.

9. The easily opened container of claim 6 wherein the means for preventing a battery whose electrode is bound within an opening of a tear strip from engaging in motion sufficient to dislodge its electrode from said opening comprises at least one cutout so placed as to at least partially enclose some portion of said battery other than the portion bound by the opening.

10. The easily opened container of claim 6 wherein the container further comprises a clear plastic wrap and hanging means.

* * * * *